United States Patent [19]

Kramer

[11] Patent Number: 4,974,420

[45] Date of Patent: Dec. 4, 1990

[54] CONTROL METHOD AND APPARATUS FOR REFRIGERATION SYSTEM

[75] Inventor: William E. Kramer, Fort Collins, Colo.

[73] Assignee: American Standard Inc., New York, N.Y.

[21] Appl. No.: 392,672

[22] Filed: Aug. 11, 1989

[51] Int. Cl.[5] ..... F25B 1/00

[52] U.S. Cl. ..... 62/115; 62/181; 62/184

[58] Field of Search ..... 62/184, 186, 209, 115, 62/181

[56] References Cited

U.S. PATENT DOCUMENTS

| | | | |
|---|---|---|---|
| 2,171,239 | 8/1939 | Gygax | 62/184 |
| 2,917,905 | 1/1954 | McGrath et al. | 62/183 |
| 2,943,457 | 3/1959 | Wile et al. | 62/184 |
| 3,004,402 | 3/1960 | Dart et al. | 62/183 |
| 3,364,692 | 12/1966 | Reynolds | 62/184 |
| 4,555,910 | 12/1985 | Sturges | 62/184 |

*Primary Examiner*—William E. Wayner

*Attorney, Agent, or Firm*—William J. Beres; David L. Polsley; William O'Driscoll

[57] ABSTRACT

In a refrigeration system including a compressor, a condenser exposed to a cooling medium for causing condensation of the refrigerant within the refrigeration system and an apparatus for controlling the flow of the cooling medium, a control method and apparatus for operating the flow control apparatus in response to suction pressure or suction temperature as sensed at the compressor. In an exemplary system utilizing air as the cooling medium and a fan for causing airflow, the fan is started after compressor start-up when sensed suction pressure rises above a predetermined amount. An additional feature includes an adaptive time limited compressor cut-out protection for low ambient temperature operation.

15 Claims, 3 Drawing Sheets

CONTROL METHOD AND APPARATUS FOR REFRIGERATION SYSTEM

DESCRIPTION

1. Technical Field

This invention pertains generally to refrigeration systems and specifically to refrigeration systems having condensers which are exposed to a flow controlled cooling medium such as air or water and an apparatus for causing the flow of the cooling medium.

2. Background Art

There are many refrigeration systems having flow controlled or forced flow cooling of the refrigeration system condenser. In such systems, either air or water is the typical cooling medium. Where air is used, one or more fans are provided to cause airflow over the condenser, and where water is used, it is not uncommon to find an electrically operated valve which is opened to permit the water to flow through a heat exchanger of which the refrigeration system condenser is part. In either case, the cooling medium removes heat from the condenser to cause condensation of the refrigerant therein.

The amount of air or water which must be used to provide adequate cooling of the condenser is dependent upon the ambient temperature of the air or water and upon the amount of heat which must be removed from the condenser. In systems utilizing water as the cooling medium, the ambient temperature of the cooling medium may be fairly constant. However, air cooled systems employed in sub-tropical and temperature zones often experience conditions where the ambient air temperature is so low that it is undesirable to utilize the fan to provide any additional cooling of the condenser because the temperature of the refrigerant is then brought undesirably low, resulting in inadequate suction pressure to provide sufficient flow to the compressor. Insufficient flow of refrigerant to the compressor can result in damage to the compressor from insufficient oil flow, as the oil is often suspended in the refrigerant, or from pressure extremes or other causes.

This low ambient temperature situation presents a particular problem for typical refrigeration systems in that such systems utilize a simple control scheme which energizes the compressor and the condenser fan or water flow control valve simultaneously as refrigeration is required. Often, the only protection against compressor damage is found in the electrical circuit, where there are included circuit breakers responsive to excessive motor load and which may or may not act in time to prevent damage to the compressor. In other systems, some additional protection is provided by a suction pressure sensor connected to a controller which will cut-out or de-energize the compressor after a certain time limit has expired without the suction pressure rising above a preset minimum pressure.

In such systems, however, the time limit must be selected to provide adequate protection in situations where the ambient temperature of the cooling medium is unusually or extremely low, which is therefore a relatively quite short time. Since this condition is by its nature unusual, the typical result is undesirable compressor cut-out in moderately low ambient temperature conditions as well.

It is also desirable to minimize the energy use of the refrigeration system, and to accomplish this it is necessary to minimize the time of operation of the condenser fan or of the time of water flow.

Therefore, it is an object of the invention to provide a means of controlling a condenser fan or water flow control valve independently of compressor operation.

It is another object of the invention to provide such a means of controlling a condenser fan or water flow control valve as will minimize energy use in a refrigeration system.

It is yet another object of the invention to provide such a means of controlling a condenser fan or water flow control valve as will provide adequate compressor protection during low ambient temperature conditions of the cooling medium.

It is also an object of the invention to provide compressor protection in low ambient temperature conditions which is self-adapting to the actual ambient temperature condition.

Finally, it is an object of the invention to provide such a means of controlling a condenser fan or water flow control valve which is inexpensive to implement and simple in operation.

These and other objects of the present invention will be apparent from the attached drawings and the description of the preferred embodiment that follows hereinbelow.

SUMMARY OF THE INVENTION

The subject invention comprises a refrigeration system having a compressor and a condenser with an inlet connected to the outlet or discharge side of the compressor. A sensor is disposed in the inlet or suction side connection of the compressor for sensing suction pressure. A signal representing the suction pressure condition is sent to an appropriate refrigeration system controller. An additional sensor is disposed to sense the temperature condition of the cooling medium. The controller includes a microprocessor for performing an algorithm to determining whether any condenser fan should be started.

In particular, the algorithm may delay the startup of the condenser fans or opening of the water flow control valve under specified conditions after startup of the compressor. In essence, the algorithm causes the microprocessor to perform the following steps: (1) determine whether the compressor is operative; (2) if so, whether the suction pressure is equal to or exceeds a preset minimum pressure; and (3) if so, then start the condenser fan or open the water flow control valve to cool the condenser.

An alternative embodiment of the algorithm adds an adaptive compressor safety cut-off to de-energize the compressor in the event that the suction pressure remains below the preset minimum pressure for a time determined by the temperature of the cooling medium, whether air or water. This adds the following steps of (4) incrementing a counter value; (5) determining a time limit value based upon the ambient temperature of the cooling medium; (6) comparing the counter value against the time limit value and de-energizing the compressor if the counter value exceeds the time limit value.

DESCRIPTION OF THE PREFERRED EMBODIMENT

Figure 1:
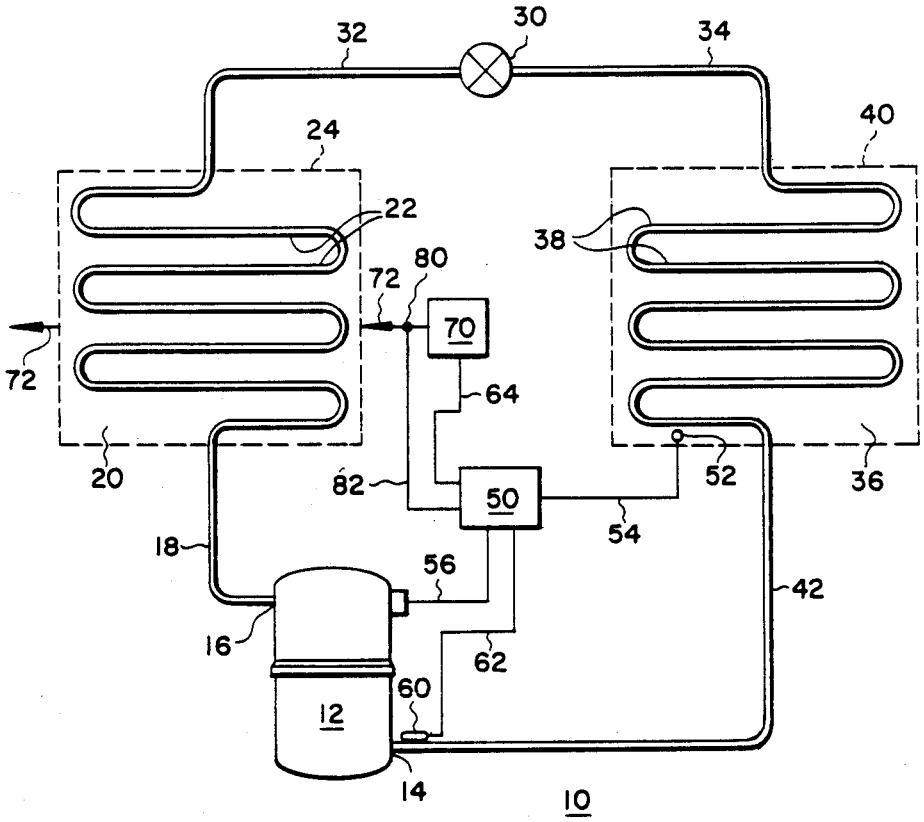
FIG. 1 depicts in schematic a refrigeration system embodying the subject invention.

A refrigeration system embodying the subject invention is generally shown in FIG. 1 and referred to by the reference numeral 10. It will be appreciated by those skilled in the art that the refrigeration system 10 is suitable for a wide variety of refrigeration and air conditioning applications.

The refrigeration system 10 includes a compressor 12 which has a suction port 14 for receiving refrigerant into the compressor 12 and a discharge port 16 for discharging refrigerant from the compressor 12. The compressor 12 may be a scroll type, a reciprocating type, or any other suitable compression apparatus. A length of tubing 18 provides a flow connection between the compressor 12 and a condenser 20. The condenser 20 is indicated generally by a multiple pass coil 22 disposed within the dotted line 24 which denotes a housing in which a cooling medium may flow for heat exchange between the refrigerant and the cooling medium.

An expansion device 30 is flow connected to the condenser 20 by another length of tubing 32. The expansion device 30 may be a thermal expansion valve (not shown), one or more lengths of capillary tubing (not shown), or preferably an electronically controlled expansion valve. Those skilled in the art will recognize that the type of expansion device utilized is not critical to the operation of the subject invention.

Another length of tubing 34 provides a flow connection between the expansion device 30 and an evaporator 36, indicated generally by a multiple pass coil 38 disposed within the dotted line 40 which denotes the space or a portion thereof to be cooled by the refrigeration system 10. The refrigerant flow path is completed by a length of tubing 42 in flow connection between the evaporator 36 and the suction port 14 of the compressor 12.

A system controller 50 is provided for controlling the operation of the refrigeration system 10 in response to specified system parameters or to external conditions or to a combination thereof, such as time or temperature. This is accomplished preferably through the inclusion of a microprocessor, electronic memory and other suitable electronic circuitry within the controller 50. Although such circuitry is not shown, it is believed that such electronic circuitry is well understood by those skilled in the relevant art and need not be disclosed in detail.

There are many embodiments of the system controller 50 and associated sensors suitable for controlling operation of the refrigeration system 10, however, for the sake of clarity, it will be assumed that the refrigeration system 10 further includes a sensor 52 connected to the controller 50 by a signal lead 54 for sensing and transmitting a signal indicating the temperature within the space 36 which is to be cooled by the refrigeration system 10. Another lead 56 is connected to the compressor 12 so that the controller 50 may transmit a signal to the compressor 12 to cause operation thereof for the duration of the signal. This is accomplished by the inclusion of the system controller 50 an electronic memory for retaining a main program and other programs or data such as sensed temperatures or pressures.

The main program is encoded as an instruction set within the electronic memory and is assumed herein to include a simple algorithm which enables the microprocessor within the controller 50 to send the signal causing compressor operation whenever, and for as along as, the sensor 52 indicates that the temperature within the space 36 has exceeded a limit preset within the algorithm. The main program also provides the necessary encoded instructions which enable the microprocessor to perform any other algorithms encoded within the electronic memory. Those skilled in the relevant arts of electronics and refrigeration systems will readily appreciate the fact that the assumptions herein are for the purposes only of providing for discussion a refrigeration system 10 which will not obscure the application of the subject invention. It should be understood that there are many additions, enhancements, and alterations of the refrigeration system 10 which may be made without exceeding the scope of refrigeration systems to which the subject invention may be applied.

Specifically, the refrigeration system 10 includes a sensor 60 disposed at or adjacent the suction port 14 of the compressor 12 and connected to the controller 50 by a lead 62 for transmitting a signal thereto. Preferably, the sensor 60 is a pressure sensor for indicating to the controller 50 the suction pressure of the refrigerant. Alternatively, however, a temperature sensor may be employed as refrigerant temperature and pressure are typically closely related. Another lead 64 connects the controller 50 to a means for causing flow of the cooling medium 70. This cooling medium flow means 70 causes a flow of the cooling medium through the condenser housing 24 upon demand or signal from the controller 50. The cooling medium flow is schematically depicted by arrows 72 and the means for causing a flow of the cooling medium 70 is also depicted schematically and will be discussed in further detail hereinafter. Finally, a sensor 80 is disposed within the cooling medium for sensing the temperature thereof and transmitting a signal representing the sensed condition to the controller 50 through a connecting lead 82.

Figure 2:
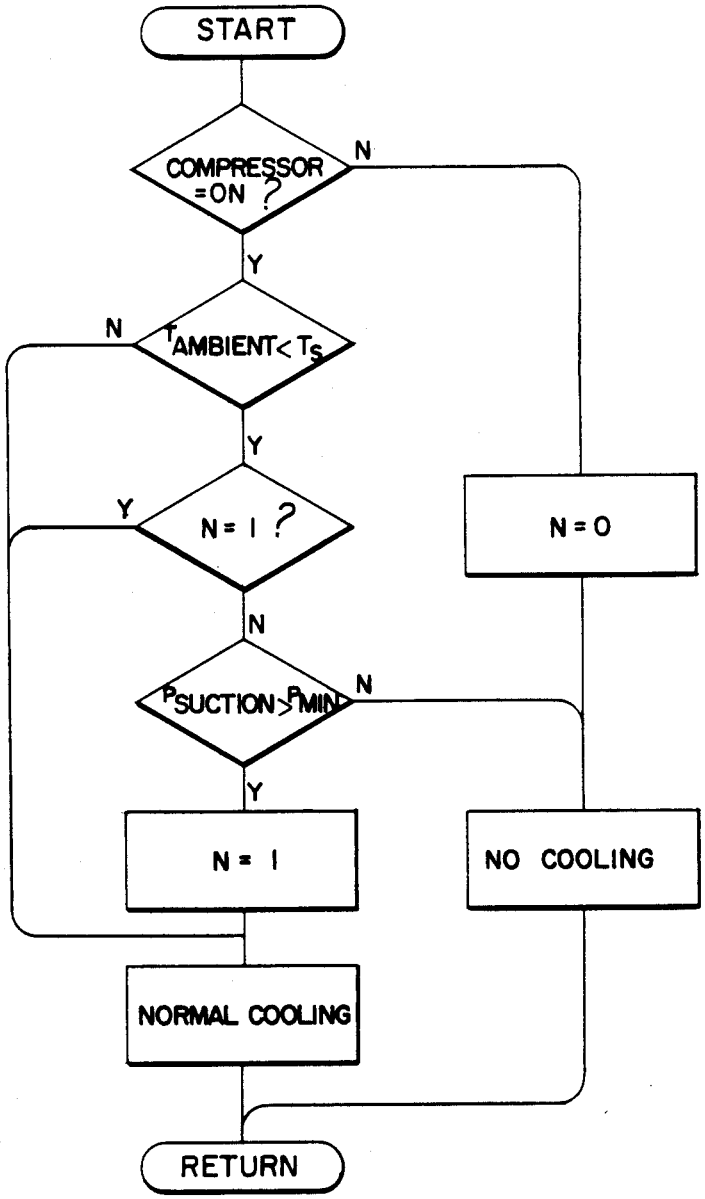
FIG. 2 shows the control method of the subject invention in flow chart form.

A flow chart representing the control method algorithm of the subject invention is disclosed in detail in FIG. 2. As is conventional, the steps are indicated with the first at the top and last at the bottom of FIG. 2. For purposes of discussion, it is assumed that the algorithm is suitably encoded as an instruction set and is periodically called to be executed by the controller 50 microprocessor according to instructions of the main program. It will be appreciated that the refrigeration system 10 could include an alternative controller dedicated to the operation of the algorithm of FIG. 2 and the flow means 70 which would be in communication with the controller 50 to accomplish similar results.

In the control method according to the algorithm, the first step after startup is to (1) determine whether the compressor is operating. This is defined as "COMP=ON?", where COMP represents one or more compressors. If not, a flag condition N is set to 0 and no cooling medium flow is initiated, represented as "NO COOLING".

If the compressor is operating, the next step is to (2) determine whether the temperature of the cooling medium is below a preset temperature, defined as $T_{ambient}$ is less than $T_s$, where $T_{ambient}$ represents the ambient temperature of the cooling medium and $T_s$ represents the selected preset temperature. If not, the algorithm sets the normal cooling medium flow as the next step, represented as "NORMAL COOLING".

If the temperature of the cooling medium is below the preset temperature, the next step is to (3) determine whether the flag condition N was last set to 0 or to 1. This is defined as the test "N=1?", where N represents the flag condition. If the flag condition was last set to 1, the algorithm (4) sets the normal cooling medium flow as the next step.

If the flag condition was last set to 0, the next step of the algorithm is to (5) determine whether the sensed suction pressure condition exceeds a threshold minimum pressure, defined as $P_{suction}$ is greater than $P_{min}$, where $P_{suction}$ is the refrigerant pressure measured at the suction port of the compressor and $P_{min}$ is a preselected minimum pressure condition. If not, (6) no cooling medium flow is initiated. If the sensed suction pressure exceeds a threshold minimum pressure, the algorithm (7) sets the flag condition N to 1 and (8) proceeds with the normal staging of cooling flow. As the last step, the algorithm (9) returns to the start step so that the cycle may be repeated.

Those skilled in the art will recognize that the step defined as "NORMAL COOLING" may represent one or more of many various cooling methods and means, for which reason the means for causing a flow of the cooling medium 70 is schematically depicted in FIG. 1. For example, where air is the selected cooling medium, the preferred means for causing a flow of the cooling medium 70 is one or more condenser fans, usually vane-axial type fans each driven by an electric motor which is energized to cause the cooling medium flow 72 when normal cooling is called for. Alternatively it is possible to stage operation of the condenser fans as needed in response to the sensed ambient temperature of the cooling medium or other parameters. Staged condenser fan operation could be accomplished by substituting an algorithm in lieu of the simple normal cooling step of the algorithm of FIG. 2 or by encoding an alternative algorithm in the electronic memory of the controller 50.

Where water is selected as the cooling medium, the means for causing a flow of cooling medium 70 is preferably comprised of a solenoid controlled valve having an open position and a closed position. When normal cooling is called for, the valve is directed to the open position for water flow and when no cooling is called for the valve is directed to the closed position to prevent water flow. Alternatively it would be possible to provide multiple valves or to provide valves having a controllably variable flow rate so that the cooling medium flow rate may be controlled by an algorithm similar to that described above for staged condenser fan control.

It is believed that no detailed description of the means of providing cooling either by condenser fans or by cooling water is necessary as those skilled in the arts of refrigeration and air conditioning are believed to be familiar with both means of condenser cooling and will readily understand the various alternatives generally described above and the suitable applications thereof.

At the time of setup of the refrigeration system 10, it is necessary to encode in the electronic memory the temperature $T_s$ and the selected suction pressure $P_{min}$. An exemplary range for $T_s$ is 35 to 45 degrees Fahrenheit and for $P_{min}$ is 15 to 50 psi pressure. The microprocessor then executes the main program, including the algorithm defined in FIG. 2, at selected intervals of preferably 1 second or less. This is done regardless of the demand for cooling at any given time, so that the demand for cooling in space 36 and the need to initiate a flow of the cooling medium is continuously determined.

In operation, refrigeration system 10 is controlled by the controller 50 in response to the sensed temperature in the space 36 according to sensor 52. The suction pressure $P_{suction}$ and the ambient temperature $T_{ambient}$ are continuously monitored by sensors 60 and 80, respectively. The microprocessor operates the controller 50 according to the main program so that the compressor 12 is activated by a signal through lead 56 when cooling is required in the space 36. When the compressor 12 is not operative, the condenser fan or water valve remains off or closed. When the compressor 12 is operative, the controller 50 will compare the ambient temperature $T_{ambient}$ sensed by sensor 80 to the selected temperature $T_s$ retained in the electronic memory and will proceed directly to a normal cooling status if the ambient temperature equals or exceeds the selected temperature, energizing the condenser fan or opening the water valve.

If $T_{ambient}$ is less than $T_s$, then the controller 50 determines from a flag condition N whether the suction pressure $P_{suction}$ at the compressor 12 had at any time reached $P_{min}$ and caused the flag condition N to be set to 1, whereupon normal cooling would be continued. If the flag condition N had been previously set to 0, then the controller 50 will determine whether $P_{suction}$, as sensed by sensor 60, is less than $P_{min}$.

If $P_{suction}$ is less than $P_{min}$, the controller 50 will not activate the cooling flow means 70 and the condenser fan or water flow valve will remain closed, but otherwise the flag condition will be set to N=1 and normal cooling will be initiated by opening the water valve or by energizing the condenser fan.

When the compressor 12 is operating and the cooling flow means 70 is not causing a flow of the cooling medium, the condenser 20 rejects less heat than when the cooling medium flows through the condenser 20. This causes refrigerant to exit the condenser 20 into the tubing 32 with relatively more heat energy and at a higher temperature. The refrigerant then has a correspondingly higher temperature throughout the refrigeration system. Those skilled in the art will recognize that, since refrigerant temperature and pressure are closely related, the refrigerant pressure at the suction port 14 will also increase, and that since there is little or no flow of cooling medium through the condenser 20, the coils 22 will reject little heat from the refrigeration system until the suction pressure $P_{suction}$ rises and the controller 50 energizes or activates the cooling medium flow means 70.

Figure 3:
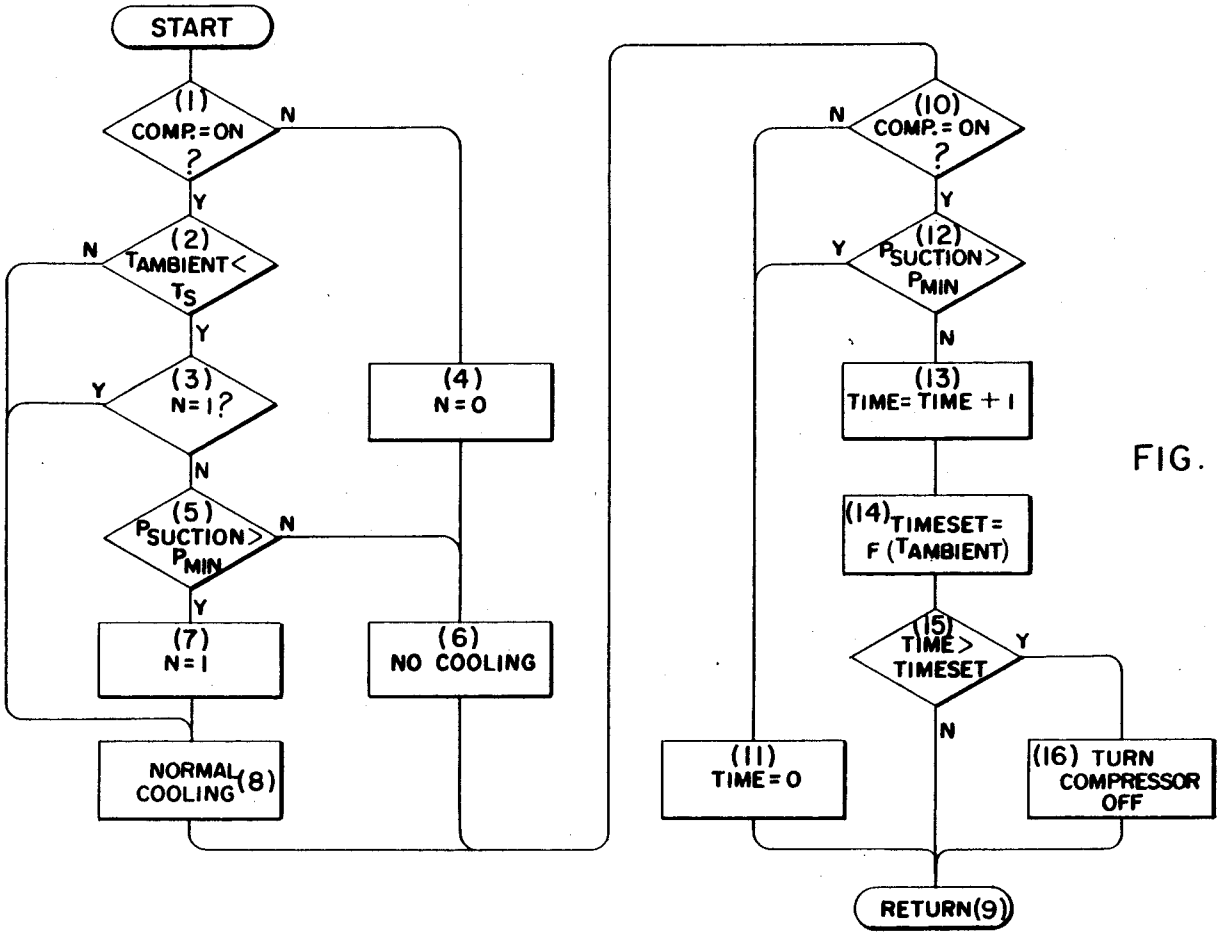
FIG. 3 shows an alternative embodiment of the control method of the subject invention in flow chart form.

An alternative embodiment of the control method is shown in FIG. 3. This alternative provides the additional benefit of low suction pressure compressor cutout in the event that the suction pressure $P_{suction}$ remains below the selection suction pressure $P_{min}$ for an undesirably long time. After performing the steps described above for FIG. 2, the algorithm performs the following steps: (10) again determines whether the compressor is operating. If the compressor is not operating, a counter preferably titled TIME is (11) set to 0 in value. The counter TIME represents an arbitrary actual time interval, which may, for example, be equivalent to time required for the execution of the algorithm or of the main program. If the compressor is operating, the next step is (12) to again determine whether $P_{suction}$ is greater than $P_{min}$. If the suction pressure $P_{suction}$ is greater than $P_{min}$, the algorithm again sets the counter TIME to the 0 value. If the suction pressure $P_{suction}$ is not greater than the selected minimum suction pressure $P_{min}$, the algorithm (13) increments the counter TIME to the next numerically greater integer value, shown as "TIME=-TIME+1".

The algorithm also (14) again senses the ambient temperature of the cooling medium $T_{ambient}$ and calculates a time limit value TIMESET based upon the ambient temperature $T_{ambient}$. Preferably the value TIMESET is a function of $T_{ambient}$ so that the value of TIMESET will be a decreasing values as $T_{ambient}$ decreases. This function is represented as "TIMESET=F($T_{ambient}$)". It will be appreciated that the function F need not be a linear mathematical relationship, and that the value of TIMESET may be varied more or less as desired in relation to different values of $T_{ambient}$ according to a variety of suitable mathematical relationships. While the preferred values of TIME and TIMESET are integers, any suitable numeric values could be employed.

Once the value TIMESET is determined, the algorithm (15) compares the current value of the counter TIME and the value TIMESET. If the counter value TIME is less than or equal to the value TIMESET, then the algorithm (9) returns to the first step and proceeds with another iteration of the algorithm as directed by the main program. However, if the counter value TIME is greater than the value TIMESET, then the algorithm (16) turns the compressor off before returning to the first step and proceeding with another iteration of the algorithm as directed by the main program.

In operation, the controller 50 operates the refrigeration system 10 according to the description of the method of FIG. 2, and then proceeds with the microprocessor to execute the additional steps according to the control method of FIG. 3. The controller 50 determines again whether the compressor 12 is on, and if not, to set the counter TIME to 0. If the compressor 12 is operating, then the controller 50 determines again whether the suction pressure has exceeded the minimum required suction pressure. If so, the counter value TIME is set to 0, but if not, the controller 50 increments the counter TIME to TIME+1, computes the value of TIMESET according to the appropriate function and sensed temperature $T_{ambient}$ of the cooling medium, and compares the values TIME and TIMESET. If the value TIME is less than or equal to the value TIMESET, the controller continues to the main program and to the first step of the FIG. 3 algorithm as dictated therein. If the value TIME is greater than the value TIMESET, the controller 50 de-energizes the compressor 12 to prevent damage thereto resulting from lack of refrigerant flow and concurrent lack of sufficient lubricant flow within the compressor 12.

Those skilled in the art will appreciate that the variable value of TIMESET according to the temperature of the cooling medium $T_{ambient}$ provides substantial protection for the compressor 12 by adapting the allowed operation time of the compressor 12 in varying conditions of low ambient temperature.

It will be appreciated that the refrigeration system 10 embodying the control method and apparatus described above comprises an advancement over the prior art in such refrigeration systems as must operate in conditions where low ambient temperatures of the cooling medium are encountered even occasionally. Furthermore, while the control method and apparatus described above is relatively easy to implement and is quite inexpensive, the reliability of the compressor 12 is substantially improved as much less time is spent operating at undesirably low suction pressure, with correspondingly inadequate lubrication of the compressor 12. Those skilled in the art will also recognize that the addition of the sensor 60 provides a means of feedback to the controller 50 so that satisfactory operation of the refrigeration system 10 can be continuously monitored.

Modification to the preferred embodiment of the subject inventions will be apparent to those skilled in the art within the scope of the claims that follow hereinbelow.

What is claimed is:

1. A method of controlling a refrigeration system circulating a refrigerant therein, said refrigeration system including at least one compressor having a discharge port and a suction port, at least one condenser exposed to a cooling medium, said condenser in refrigerant flow connection with said compressor discharge port, and means of causing a cooling medium to flow with respect to said condenser, said control method comprised of:

determining whether the compressor is operating;

sensing a condition of said refrigerant at said compressor suction port;

operating said cooling medium flow means when said compressor is determined to be operating and when said sensed refrigerant condition exceeds a pre-selected condition.

2. The control method as set forth in claim 1 wherein said control method further includes the step of providing a controller having a memory for retaining said preselected condition.

3. The control method as set forth in claim 2 wherein said control method further includes the step of providing a microprocessor in said controller for executing an algorithm representing said control method.

4. The control method as set forth in claim 3 wherein said control method includes the further step of sensing the ambient temperature of the cooling medium.

5. The control method as set forth in claim 4 wherein said control method includes the further steps of:

alternatively determining whether said sensed ambient temperature meets a preset condition; and operating said cooling medium flow means when said compressor is determined to be operating and when said sensed ambient temperature meets said preset condition, without determining whether said sensed refrigerant condition equals said preselected condition.

6. A method of controlling a refrigeration system circulating a refrigerant therein, said refrigeration system including at least one compressor having a discharge port and a suction port, at least one condenser exposed to a cooling medium, said condenser in refrigerant flow connection with said compressor discharge port, and means of causing a cooling medium to flow with respect to said condenser, said control method comprised of:

determining whether the compressor is operating;

sensing an ambient temperature of the cooling medium;

determining whether said sensed ambient temperature is less than a preset condition;

sensing a condition of said refrigerant at said compressor suction port;

determining whether said sensed refrigerant condition is greater than a preset refrigerant condition; and operating said cooling medium flow means when said compressor is operating, when said sensed refrigerant condition is greater than said preselected condition and when sensed ambient temperature is less than said preset condition.

7. The control method as set forth in claim 6 wherein said control method includes the further step of providing air as a cooling medium.

8. The control method as set forth in claim 7 wherein said control method includes the further step of operating a fan disposed to provide said air to said condenser.

9. The control method as set forth in claim 6 wherein said control method includes the further step of providing water as a cooling medium.

10. The control method as set forth in claim 9 wherein said control method includes the further step of operating a valve to cause said flow of water.

11. A method of controlling a refrigeration system circulating a refrigerant therein, said refrigeration system including at least one compressor having a discharge port and a suction port, at least one condenser exposed to a cooling medium, said condenser in refrigerant flow connection with said compressor discharge port, and means of causing a cooling medium to flow with respect to said condenser, said control method comprised of:

determining whether the compressor is operating;

sensing an ambient temperature of the cooling medium;

determining whether said sensed ambient temperature is less than a preset condition;

sensing a condition of said refrigerant at said compressor suction port;

determining whether said sensed refrigerant condition is greater than a preset refrigerant condition;

operating said cooling medium flow means when said compressor is operating, when said sensed refrigerant condition is greater than said preselected condition and when sensed ambient temperature is less than said preset condition;

incrementing a counter value when said sensed refrigerant condition is less than a preset refrigerant condition;

calculating a limit value as a function of said sensed ambient temperature;

determining whether said counter value is greater than said limit value; and rendering said compressor inoperative when said counter value is greater than said limit value.

12. A refrigeration system for circulating a refrigerant therein, said refrigeration system comprised of:

a compressor having a discharge port and a suction port;

a condenser in flow connection with said discharge port, said condenser having a housing for accepting a flow of cooling medium therethrough;

a refrigerant expansion means in flow connection with said condenser;

an evaporator in flow connection with said refrigerant expansion means, said evaporator further being in flow connection with said suction port of the compressor;

means for causing a flow of cooling medium, said cooling medium flow means providing a flow of cooling medium in heat exchange contact with said condenser;

means for determining whether the compressor is operating;

means for sensing a condition of said refrigerant at said compressor suction port; and means for controlling the operation of the refrigeration system, said control means further comprising means for operating said cooling medium flow means when said sensed refrigerant condition exceeds a preselected condition and said compressor is operating.

13. The refrigeration system as set forth in claim 12 wherein said control means is further comprised of an electronic memory and a microprocessor for executing instruction sets retained within said electronic memory.

14. The refrigeration system as set forth in claim 13 wherein said refrigeration system further comprises means for sensing an ambient temperature of the cooling medium.

15. The refrigeration system as set forth in claim 14 wherein said instruction sets further comprise:

means for determining whether said sensed ambient temperature meets a preset condition; and means for operating said cooling medium flow means when said compressor is operating and when sensed ambient temperature meets a preselected condition and for alternatively operating said cooling medium flow means when said compressor is operating, when said sensed refrigerant condition exceeds a preselected condition and when sensed ambient temperature does not meet a preset condition.

* * * * *

UNITED STATES PATENT AND TRADEMARK OFFICE

CERTIFICATE OF CORRECTION

PATENT NO. : 4,974,420

DATED : December 4, 1990

INVENTOR(S) : William E. Kramer

It is certified that error appears in the above-identified patent and that said Letters Patent is hereby corrected as shown below:

Column 1, line 32, "temperature" should read --temperate--.

Column 4, line 8, after the word "other" insert --function desired and to appropriately execute any other--.

Column 7, line 11, "values" should read --value--.

Signed and Sealed this

Twelfth Day of May, 1992

*Attest:*

DOUGLAS B. COMER

*Attesting Officer*

*Acting Commissioner of Patents and Trademarks*